US010231479B2

(12) United States Patent
Coltrane

(10) Patent No.: US 10,231,479 B2
(45) Date of Patent: Mar. 19, 2019

(54) CIGARETTE TUBE FILLING APPARATUS AND METHOD OF USING THE SAME

(71) Applicant: Don Coltrane, Thomasville, NC (US)

(72) Inventor: Don Coltrane, Thomasville, NC (US)

( * ) Notice: Subject to any disclaimer, the term of this patent is extended or adjusted under 35 U.S.C. 154(b) by 712 days.

(21) Appl. No.: 14/763,878

(22) PCT Filed: Jan. 29, 2014

(86) PCT No.: PCT/US2014/013643

§ 371 (c)(1),
(2) Date: Jul. 28, 2015

(87) PCT Pub. No.: WO2014/120802

PCT Pub. Date: Aug. 7, 2014

(65) Prior Publication Data

US 2015/0366263 A1 Dec. 24, 2015

Related U.S. Application Data

(60) Provisional application No. 61/757,781, filed on Jan. 29, 2013.

(51) Int. Cl.

| | |
|---|---|
| ***A24C 5/02*** | (2006.01) |
| ***A24C 5/06*** | (2006.01) |
| ***A24C 5/42*** | (2006.01) |

(52) U.S. Cl.
CPC ..... *A24C 5/02* (2013.01); *A24C 5/06* (2013.01); *A24C 5/42* (2013.01)

(58) Field of Classification Search
None
See application file for complete search history.

(56) References Cited

U.S. PATENT DOCUMENTS

| | | | |
|---|---|---|---|
| 4,572,216 | A | 2/1986 | Josuttis et al. |
| 5,072,740 | A | 12/1991 | Gatschmann et al. |
| 6,913,022 | B2 | 7/2005 | Moser et al. |
| 2007/0295343 | A1 | 12/2007 | Susanto et al. |

*Primary Examiner* — Michael J Felton
*Assistant Examiner* — Katherine A Will

(57) ABSTRACT

Herein described is a cigarette filling apparatus for loading substrate into blank cigarette tubes and adapted for use with conventional cigarette filling machines. The invention furthermore relates to methods of filling blank cigarette tubes using the apparatus described herein. The apparatus described herein reduces human error and increases filling speeds of conventional personal use cigarette filling machines. The apparatus generally comprises a tube dispensing member, a filler dispensing member, a tube loading arm, packing foot, filler hopper, and a tube hopper.

8 Claims, 9 Drawing Sheets

CIGARETTE TUBE FILLING APPARATUS AND METHOD OF USING THE SAME

CROSS REFERENCE TO RELATED APPLICATIONS

This application claims priority to U.S. Provisional Patent Application Ser. No. 61/757,781 filed Jan. 29, 2013. The disclosure of U.S. Provisional Patent Application 61/757,781 is incorporated by reference herein in its entirety.

FIELD

The present invention relates to a cigarette filling apparatus for loading substrate into blank cigarette tubes and adapted for use with conventional cigarette filling machines. The invention furthermore relates to methods of filling blank cigarette tubes using the apparatus described herein.

BACKGROUND

Off the shelf cigarette filling machines currently on the market (particularly those for home or personal use) are slow, lack durability or dependability, and result in frequent mauling of the cigarette blanks and resulting in significant time, effort, and money wasted. One problem frequently encountered in existing machines for personal home use is that the blanks are extremely delicate and are typically loaded for filling by hand. Thus, human error frequently results in a mangled, ripped, or shredded blank. For example, even a small amount of pressure exerted by the user's finger tips often bends the blank as it is being transferred to the nipple extruder on apparatus resulting in tears and mangling. Furthermore, the blank must be transferred to the nipple of the apparatus in the proper position and failure to do so may also result in mauling of the blank as the tobacco or other substrate is fed into it. As mentioned above, these personal use machines are very slow since the user must pick up and load the blanks one by one by hand. The human error caused by dropped blanks, as well as torn or ripped blanks dramatically slows down the process as does the number of arm and hand movements necessary for each blank. User fatigue is also a factor. What is needed therefore is an apparatus that loads cigarettes using the small, personal use machines, improving efficiency and speed, reducing user fatigue, and also minimizing damage to the blanks.

SUMMARY

One object of the present invention is to provide a cigarette filling apparatus for loading substrate into blank cigarette tubes that is adapted for use with conventional cigarette filling machines. Another object of the present invention is to provide an apparatus for loading substrate into blank cigarette tubes comprising a tube dispensing member and a filler dispensing member.

In some embodiments the tube dispensing member temporarily stores blank cigarette tubes, dispenses blank cigarette tubes for filling in a controlled manner, and presents said blank cigarette tubes to said cigarette filling machine for filling with desired substrate and a filler chamber. In some embodiments, the filler dispensing member temporarily stores the desired substrate in said filler chamber, advances the substrate to the cigarette filling machine in a controlled manner, and packs the substrate into the cigarette filling machine for loading into the blank tube with said packing foot.

In one embodiment, the tube dispensing member comprises a tube hopper, a tube loading arm, and a platform. In some embodiments, the tube hopper further comprises a ramp for advancement of tubes for filling. In another embodiment, the ramp may further comprise a secondary wall or barrier for restricting the size of the blank positioned within said hopper on said ramp. In yet another embodiment, the ramp comprises a slot at one end of the ramp wherein an empty cigarette blank may pass through. In yet another embodiment, the tube loading arm rests upon said platform wherein each of the tube loading arm and the platform are positioned underneath the ramp. In some embodiments, the tube loading arm further comprises an extension protruding from the underside of the arm which may further comprise a hook for receiving a rubber band or other retention element, such as a spring. In other embodiments, the platform, upon which the tube loading arm may rest, comprises one or more slots for receiving the tube loading arm extension. Said slots may be set at a predetermined angles to the side of the cigarette filling machine and the nipple for guiding the extension, the tube loading arm, and thereby the open end of the cigarette blank carefully and precisely to the nipple of a conventional cigarette filling machine. In an alternative embodiment, the tube loading arm pivots about a central pivot point through its engagement with the platform. In some embodiments, the tube loading arm is connected to a retention element which is used to return the arm to a primary position for loading with an empty blank. In some embodiments, the tube loading arm may comprise a tube press, a tube contact surface, and a tab each of which is designed hold the blank tube in the proper position for presentation to the cigarette rolling machine nipple.

In one embodiment the filler dispenser member comprises a filler chamber and, in yet additional embodiments, the filler chamber further comprises a filler hopper, a filler roller, and a packing foot. The packing foot may comprise a first member and a second member for securing one end of a retention element. Likewise the filler hopper may comprise a first member and a second member for securing a second end of a retention element. In some embodiments, the filler chamber may comprise a rear extension, a first front leg, and a second front leg for securing to a front side and a rear side of a cigarette filling machine. The filler chamber may also comprise a base which secures to or engages with a top surface of a cigarette filling machine.

Another object of the present invention is to provide a method for filling empty cigarette tubes with filler. In one embodiment, the method may comprise the steps of placing empty tubes in a tube dispenser member comprising a tube hopper and a tube loading arm, placing filler in a filler dispenser member comprising a filler chamber and a packing foot, advancing filler through the tube hopper and into a filler receptacle defined in a conventional cigarette filling machine by filler roller, sliding said packing foot downward and compacting the filler into the filler receptacle of a conventional cigarette filling machine, activating said tube loading arm loaded with a blank tube toward the nipple of a conventional cigarette filling machine open end first, releasing said tube loading arm wherein said blank tube remains suspended on said nipple; and activating the filling mechanism of a conventional cigarette filling machine.

BRIEF DESCRIPTION OF THE DRAWINGS

Representative embodiments of the invention are disclosed in more detail with reference to the following figures.

Like reference numerals designate corresponding parts or steps throughout the different views.

DETAILED DESCRIPTION

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices.

Throughout the specification and claims, the following terms take the meanings explicitly associated herein, unless the context clearly dictates otherwise. The phrase "in one embodiment" or "in some embodiments" or "in a preferred embodiment" (or similar phrases) as used herein does not necessarily refer to the same embodiment, though it may. Furthermore, the phrase "in another embodiment" (or similar phrases) as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

It should be noted that although the discussions herein may refer to a specific order and composition of method steps, it is understood that the order of these steps may differ from what is described. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative embodiments. Accordingly, all such modifications are intended to be included within the scope of the present invention.

Figure 1:
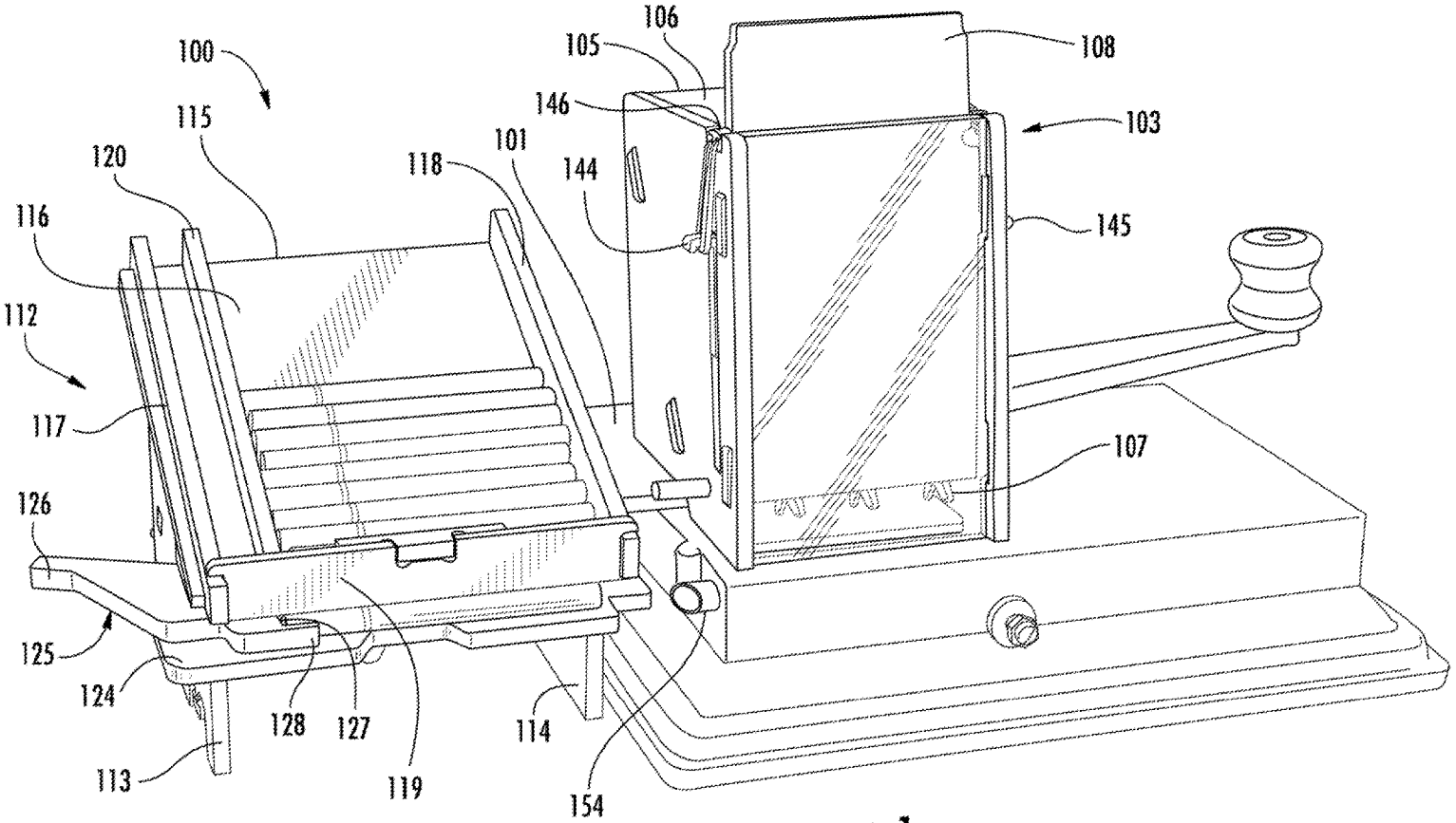
FIG. 1 shows a front view of an embodiment of the present invention.
Figure 2:
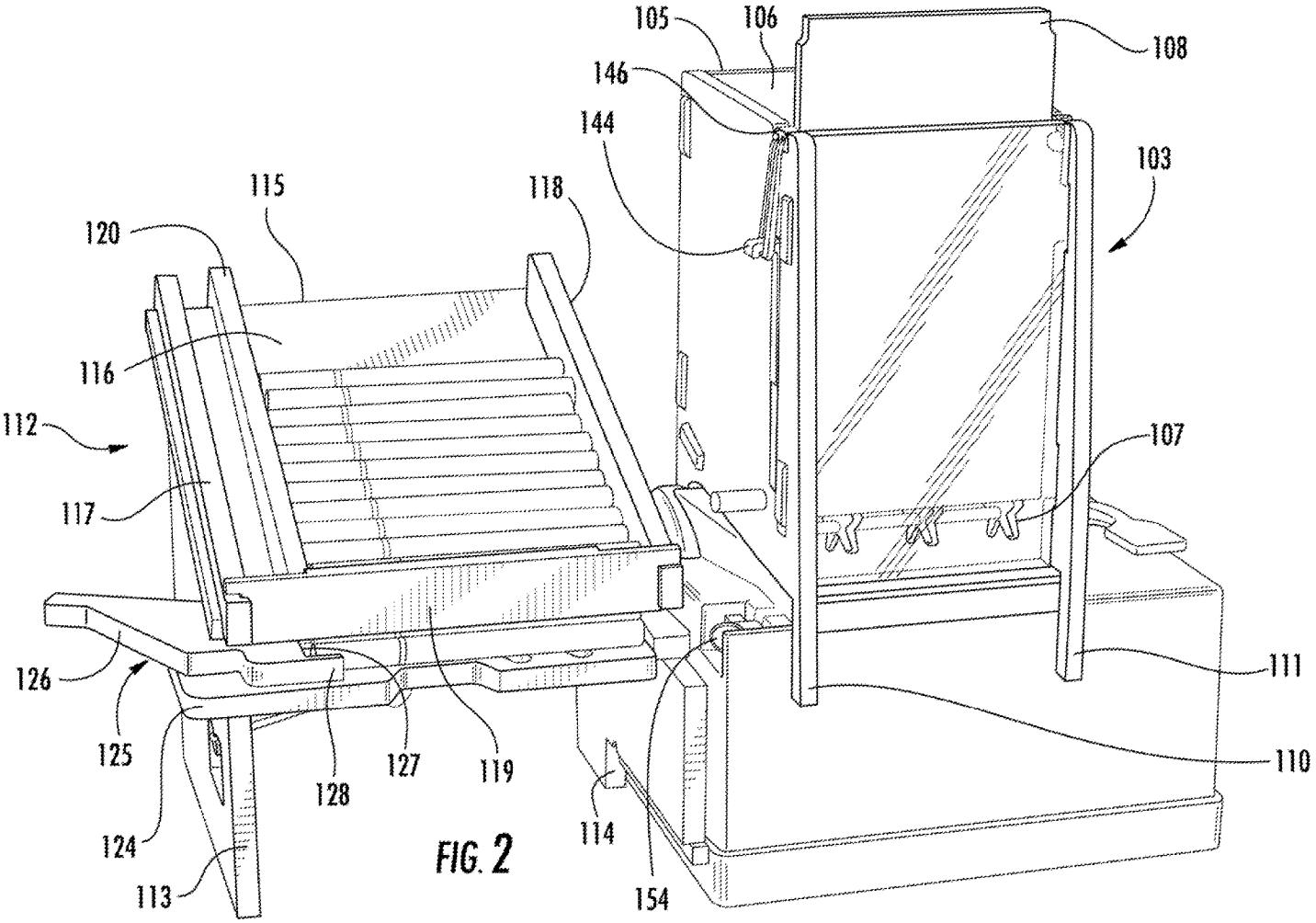
FIG. 2 shows a front view of an alternative embodiment of the present invention.

Referring now to the embodiment depicted in FIG. 1, the cigarette filling machine adapter 100 may comprise a base or platform 101 upon which the apparatus rests. Base 101 may partially engage a surface of an off the shelf cigarette filling machine such that the adapter 100 is substantially stationary with little to no change in position while used for its intended purpose. As shown in the embodiment depicted in FIG. 1, engaged to a first surface 102 of base 101 is a filler dispenser member 103 comprising an arm 104 (not shown in this illustration) engaged to or resting upon the first surface 102 of base 101, filler chamber 105, filler hopper 106, filler roller 107, and a packing foot 108. As shown in FIG. 1, however, the base 101 of filler dispenser member 103 may rest directly and engage the surface of the cigarette filling machine directly and omit arm 104 altogether. Alternatively, as illustrated in FIG. 2, the apparatus may not have a base 101.

Figure 4A:
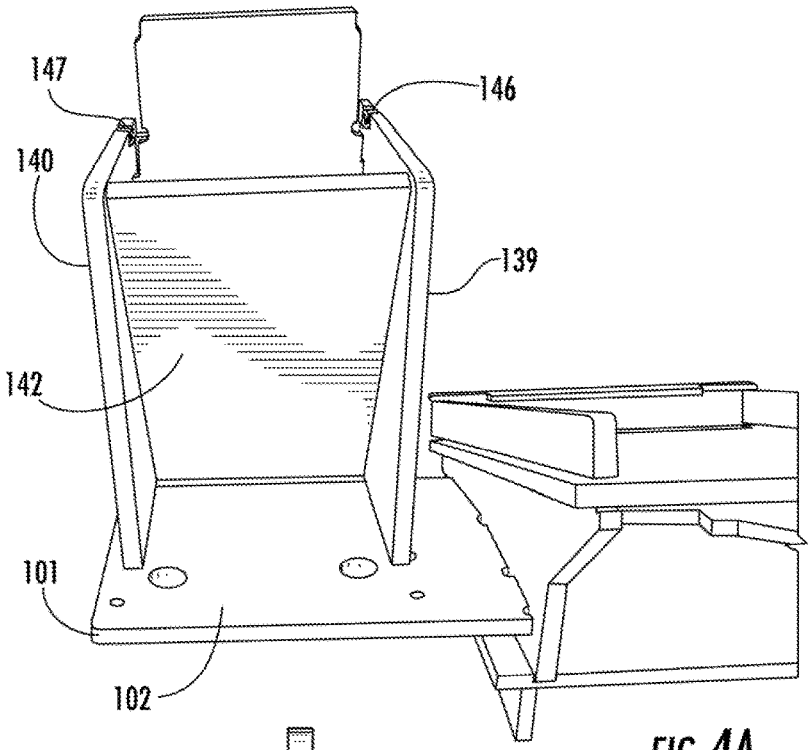
FIG. 4A-B shows embodiments of the filler dispenser member.
Figure 4B:
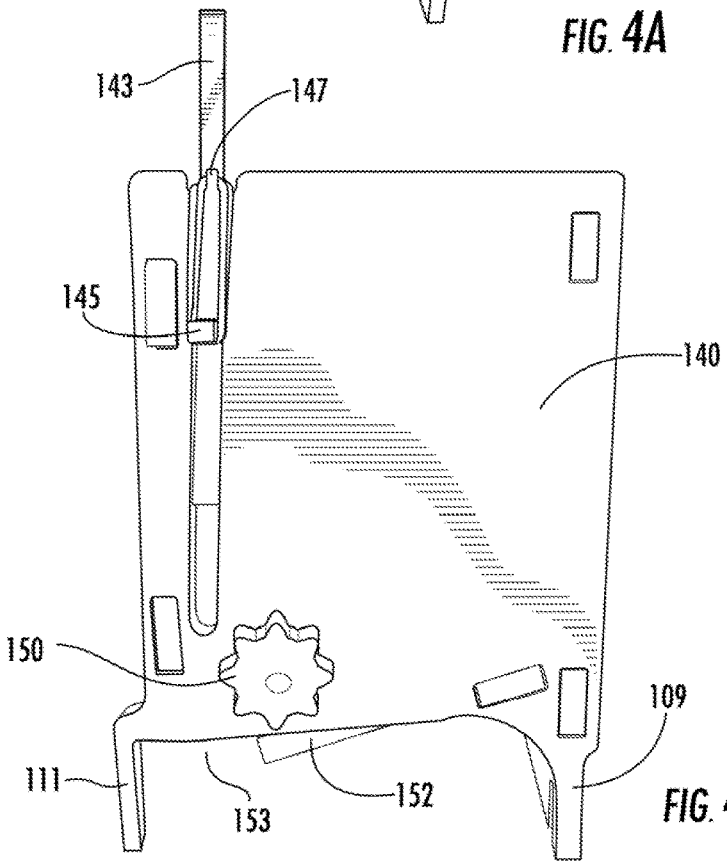
Figure 5:
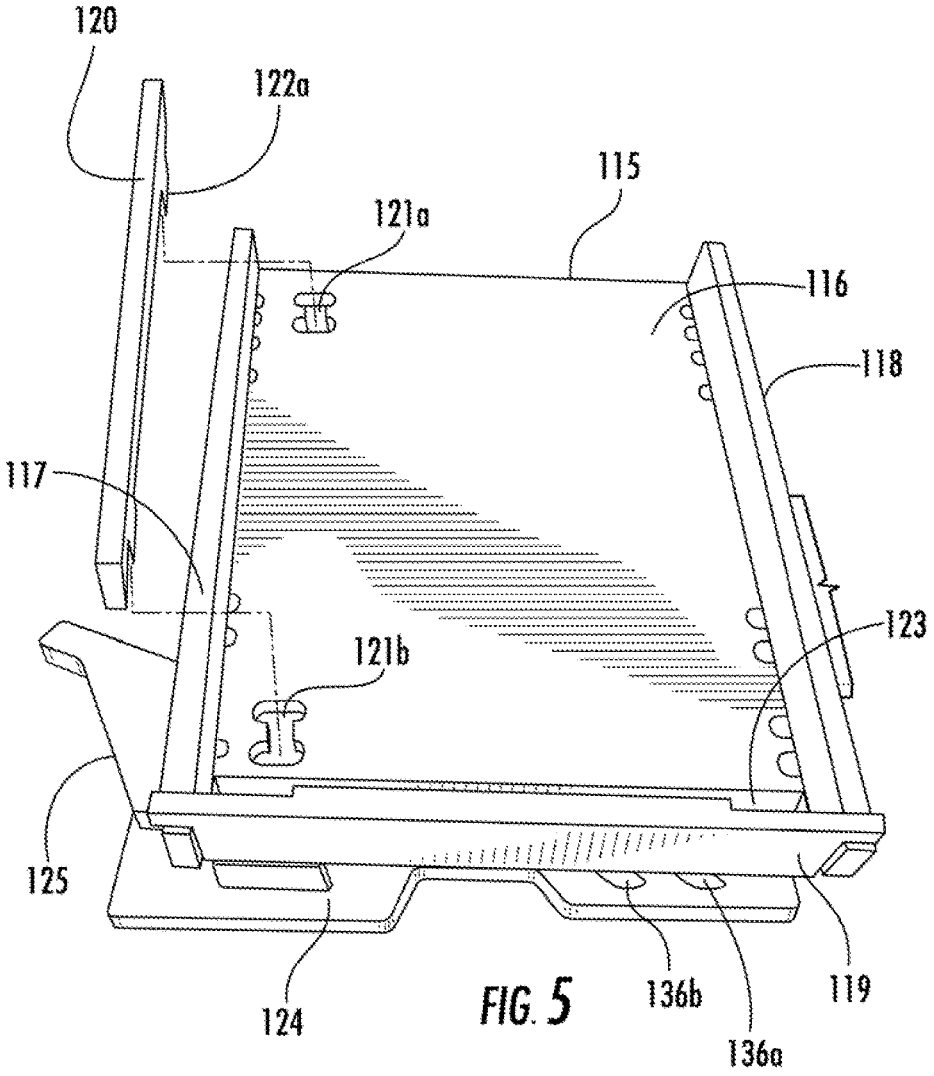
FIG. 5 shows a tube dispensing member ramp and tube barrier attachment.

In yet another embodiment, base 101 may be engaged to and positioned underneath the filler chamber 105, for example, as depicted in FIG. 1 and FIG. 4B. In this embodiment base 101 is a flat surface and is secured (e.g. snapped) to existing structures present on the top surface of the conventional cigarette filling machine.

Figure 3:
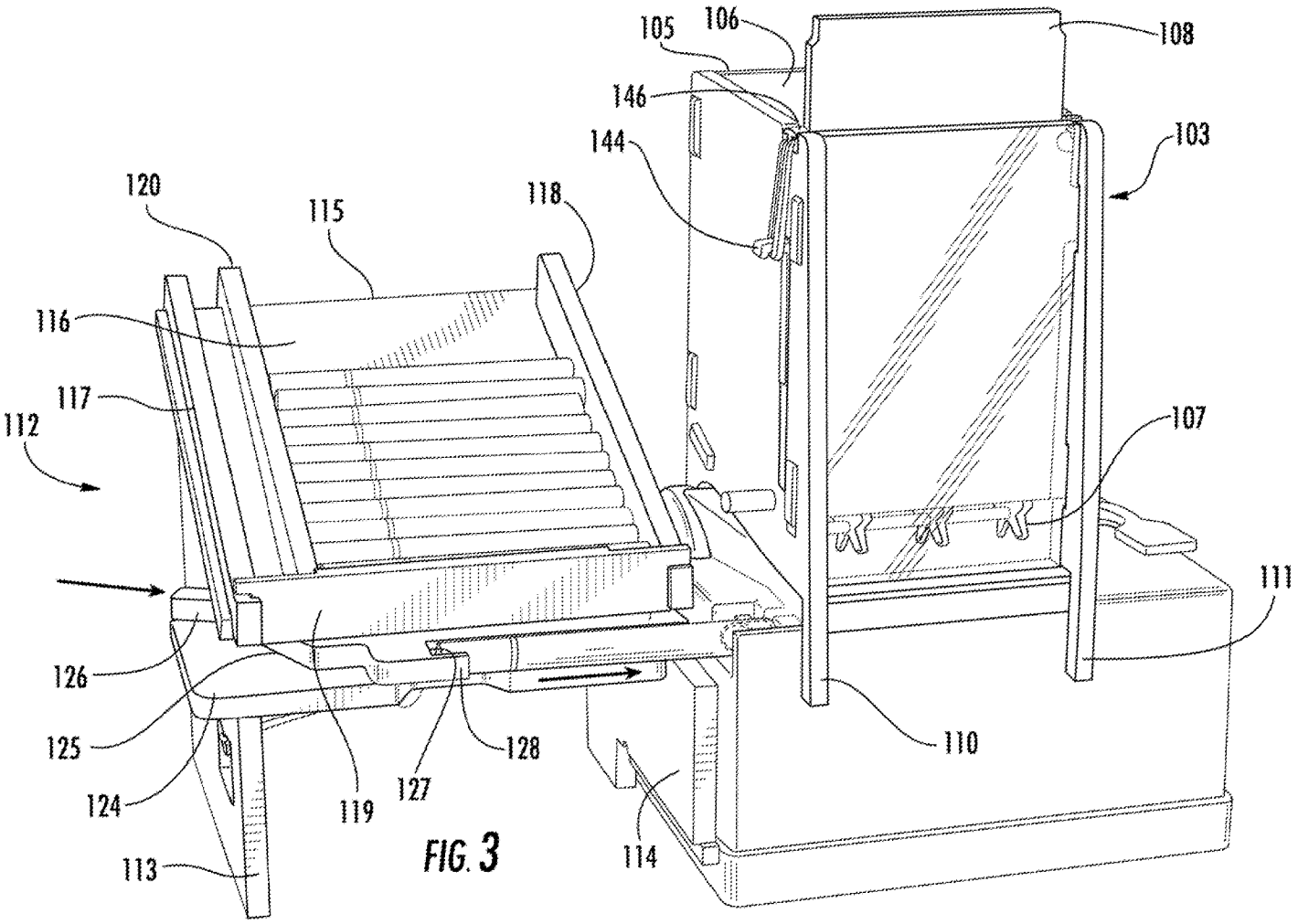
FIG. 3 shows a front view of an embodiment of the present invention with tube loading arm in motion and presenting a tube to the cigarette machine nipple.

In another embodiment, filler dispenser member 103 may comprise stabilizing extension 109, first arm 110, and second arm 111 which extend down the front and rear sides of the cigarette filling machine providing additional support to the filler dispenser member 103. This embodiment is illustrated in FIGS. 2, 3 and 4A. In said embodiment, the filler dispenser member 103 rests upon the top surface of the cigarette filling machine and is supported by extension 109, first arm 110, and second arm 111.

The apparatus may comprise a tube dispenser member 112 engaged to first surface 102 of base 101 (not illustrated). In the embodiment illustrated in FIG. 2, tube dispenser member 112 comprises a first leg 113 and second leg 114 each engaged to first surface 102 of base 101 (not illustrated) to support and elevate the other components of tube dispenser member 112 to their proper position for accurate tube filling. In some embodiments, the tube dispenser member 112 may comprise more than two legs or may omit legs altogether. It should be recognized that other structures for supporting tube dispenser member 112 may be equally suitable for the purposes of the present invention as long as said tube dispenser member is stable, substantially supported and elevated to the proper position/height for accurate delivery and placement of the blank cigarette tube's open end to the cigarette filling machine nipple for filling with substrate. For example, the embodiment shown in FIGS. 2 and 3 omits a base 101 positioned underneath said tube dispensing member. Rather, the tube dispenser member 112 in said embodiment is supported by a first leg 113 and an opposing second leg 114 which directly engages or rests upon a support surface such as a table, countertop, or tray.

Tube dispenser member 112 further comprises a tube hopper 115 for placement and positioning of tubes for filling. It will be recognized by those of skill in the art that tube hopper 116 may be of any size and shape and may be loaded with any number of tubes (one or more). As shown in FIGS. 1 and 4B, tube dispenser member 112 may be engaged to filler dispenser member 103 and, in fact, may form a unitary structure with filler dispenser member 103 such that first leg 113 and second leg 114 are not needed to support the structure. Legs or some other support element may be used, however, in this embodiment.

As shown in the embodiment illustrated in FIGS. 1-3 and 5, tube hopper 115 may comprise ramp 116 and a first side 117, second side 118 and third side 119. Ramp 116 may be inclined whereby tubes placed within tube hopper 115 are drawn by gravity toward third side 119 which in this embodiment is the lower end of the ramp. In one embodiment, ramp 116 is adapted to receive a tube barrier 120 for accommodating different sizes of tubes. For example, in the embodiment shown in FIG. 5, tube barrier 120 may be placed within tube hopper 115 on ramp 116 and engaged thereto with tube barrier supports which, in this embodiment, are slots 121*a* and 121*b* and extensions 122*a* and 122*b*. Tube barrier 120 is used when shorter blank tubes and thus shorter cigarettes are desired. In the embodiment shown in FIG. 5, proximal to third side 119, ramp 116 comprises slot 123 of sufficient dimension to allow a blank tube to pass through. In this embodiment, slot 123 is formed within the floor of ramp 116 proximal said third side 119. As blank tubes progress down the ramp 116, they pass through slot 123 onto platform 124 if slot 123 is not occluded by tube loading arm. The platform and tube loading arm elements are discussed more fully below.

With continued reference to the embodiment illustrated in FIGS. 1-3, tube dispenser member 112 may comprise a platform 124 substantially underneath slot 123 in ramp 116 of tube hopper 115. Once a blank tube passes through slot 123 it comes to rest on platform 124 and awaits engagement with a tube loading arm 125 which is supported by and engaged to tube dispenser member 112.

Figure 7A:
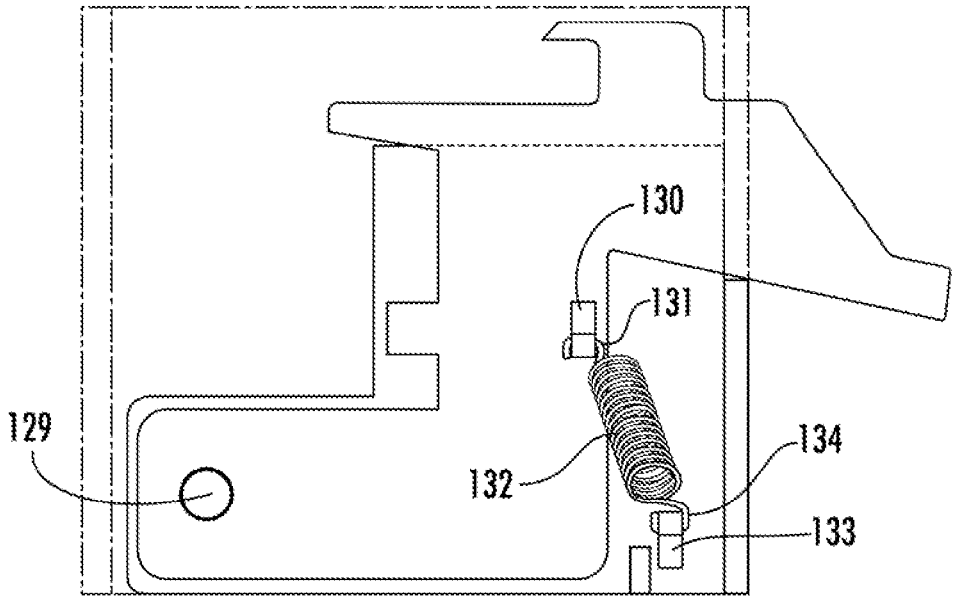
FIG. 7A-B shows an embodiment of a spring activated tube loading arm pivoting about a central point.
Figure 7B:
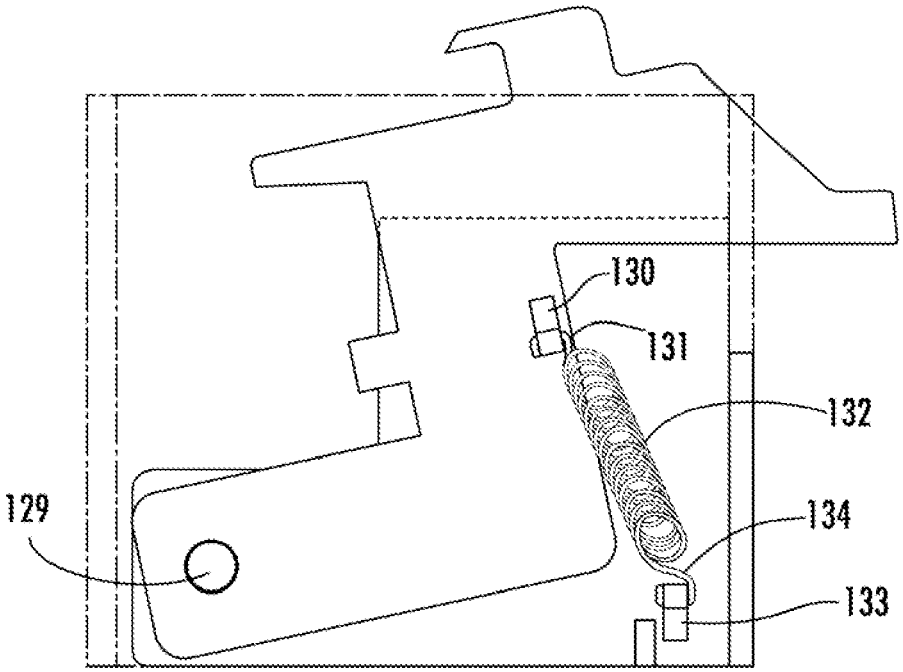
Figure 8A:
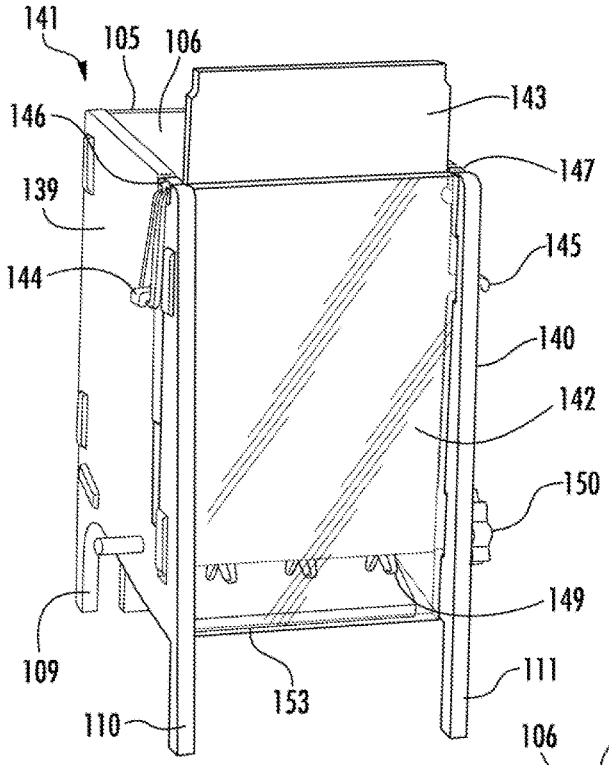
FIG. 8A-B shows an embodiment of a filler dispenser member with the packing foot being pressed.
Figure 8B:
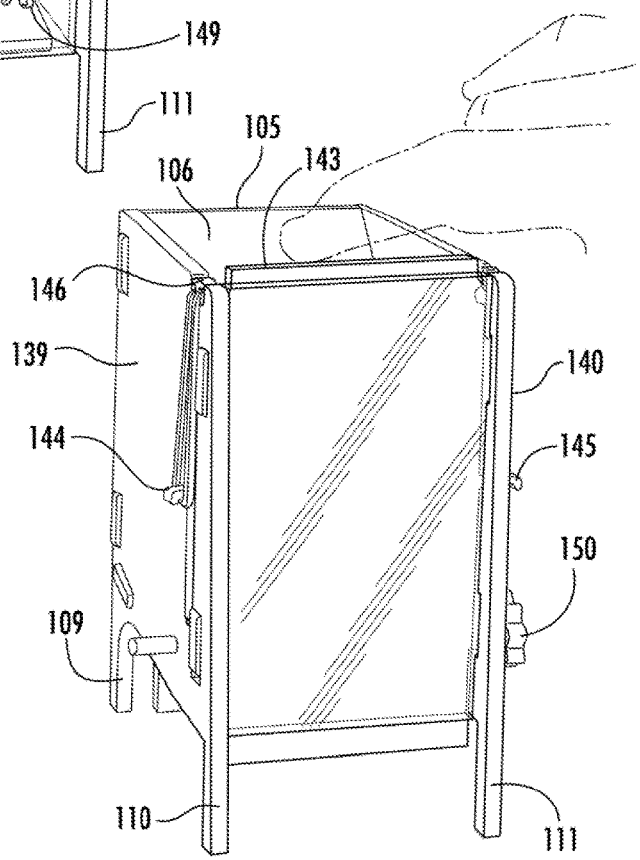

In the embodiment shown in FIGS. 1 and 2, tube loading arm 126 may comprise a press or lever 126, tube contact surface 127, and tab 128 which prevents unwanted movement of a tube once engaged with tube loading arm 125. In one embodiment (see FIGS. 7A-7B), tube loading arm 126 engages platform 124 at pivot 129 which allows tube loading arm 125 to rotate about a central axis point defined by the center point of pivot 129. The tube loading arm 125 shown in FIGS. 7A-7B, further comprises a first spring retention element 130 that engages first end 131 of spring 132. Platform 124 also comprises second spring retention element 133 that engages the second end 134 of spring 132. Spring 132 applies a retraction force to tube loading arm whereby tube loading arm 125 is returned to loading position after delivery of a tube to filler dispenser member 103 for filling.

Figure 6A:
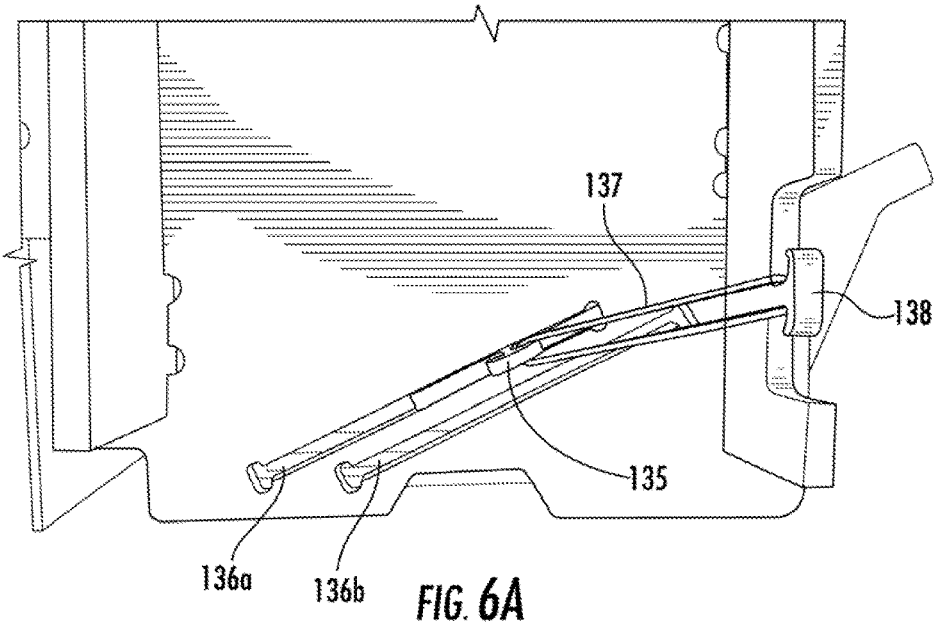
FIG. 6A-B shows an embodiment of the tube loading arm extension guided by slots and retention elements.
Figure 6B:
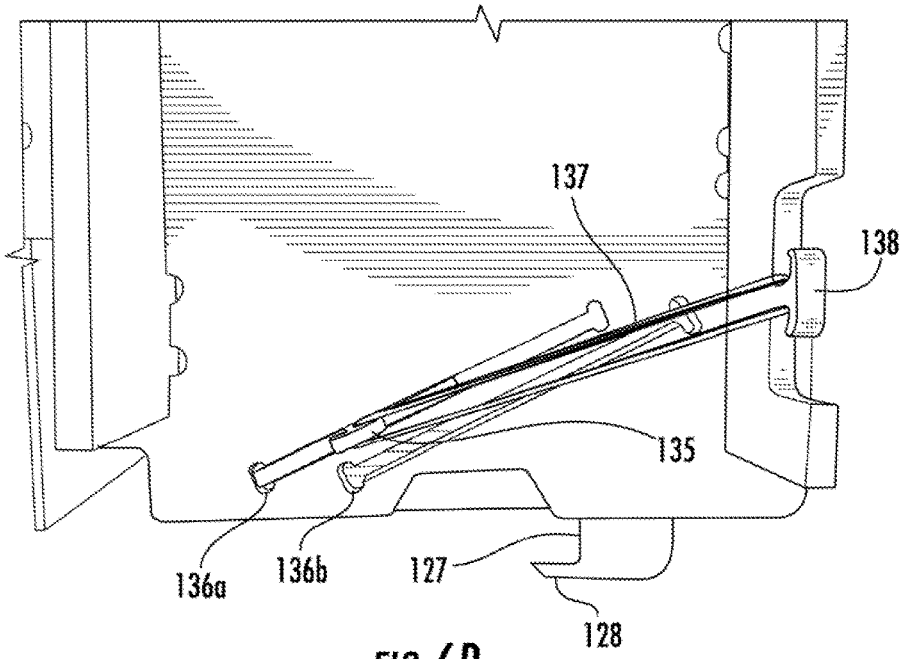
Figure 9A:
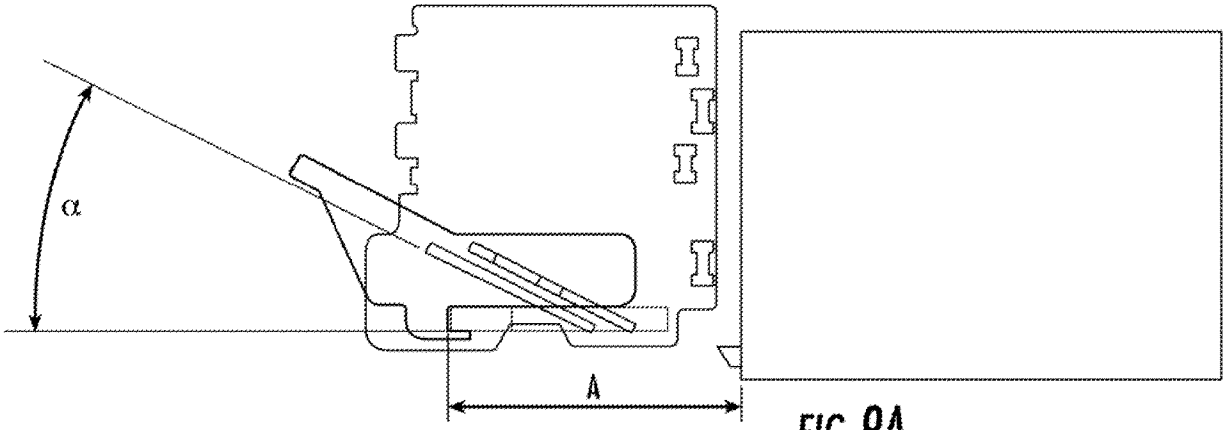
FIG. 9A-B shows an embodiment of certain critical angles and measurements associated with a fully functioning tube dispenser member mechanism.
Figure 9B:
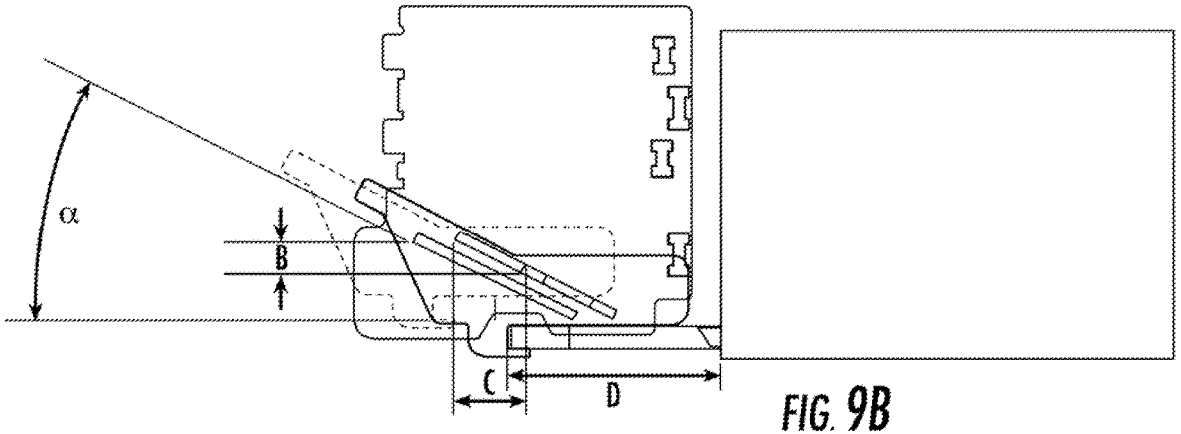

In another embodiment illustrated in FIG. 6A-6B, tube loading arm 125 may engage platform 124 through extension 135 defined on the underside of tube loading arm 126 and grooves 136*a* and 136*b* defined in platform 124. In this embodiment, two grooves are provided to accommodate two different sizes or lengths of blank tubes; however, it is noted that a single groove or more than two grooves may be provided. In this embodiment, the grooves defined in platform 124 are at a precisely defined and predetermined angle (e.g. a as illustrated in FIG. 9) and position whereby as the extension 135 travels through grooves 136*a* or 136*b*, the tube loading arm 125 guides the blank tube directly to the cigarette filling machine nipple such that the open end is carefully inserted onto the nipple (e.g. overlapping the hard exterior surface of the nipple) without molesting, tearing, or bending the delicate paper. In one embodiment, a is about 25.3129° in relation to the axis shown as A-1 in FIG. 9. Moreover, it should be noted that grooves 136*a* and 136*b* are each positioned precisely to direct a blank tube of two different sizes to the nipple of the cigarette filling machine. The positioning (depending on the tube size) and the angle of the groove are important to the successful delivery of the blank tube to the nipple without molestation, tearing or bending. In one embodiment, the distance between the two grooves 136*a* and 136*b*, which proportionally relates to the difference in length between two sizes of cigarettes, is about 0.5993 inches.

As shown in this embodiment, tube loading arm 125 and platform 124 may not be engaged at pivot 129 as illustrated in FIGS. 6A-6B or use springs as retention elements for the arm 125. Rather, tube loading arm 125 may use other equally suitable retention elements, such as a rubber band or the like. For example, in the embodiment shown in FIG. 6A, extension 135 is defined as a hook for receiving retention element 137 (in this embodiment a rubber band) at one end. The other end of retention element 137 is received by a second hook 138 defined within first leg 113 of tube dispenser member 112. In this embodiment, connecting retention element 137 to extension 135 (or first hook) and extension 138 (or second hook) yields tension on the tube loading arm 125 causing the arm 125 to return to its primary position after delivery of a blank tube to the nipple. The primary position of tube loading arm 125 may be defined as the position necessary to receive a blank tube from tube hopper through slot 123.

In one embodiment, tube loading arm 125 and platform 124 are designed such that at the precise moment the open end of the blank tube is placed on the nipple of the cigarette filling machine the blank tube has cleared platform 124 allowing the tube to be forced off the nipple upon filling and fall to a support surface (countertop, table, floor) thereby automatically clearing the way for another blank tube to be loaded on the nipple. As illustrated in FIG. 9 (designated as "B"), in one embodiment, distance along the Y axis that the tube loading arm travels from start to finish (delivery and positioning of the cigarette tube on the nipple) is about 0.5289 inches. Furthermore, in some embodiments, at the fully extended, open or start position, the distance between tube contact surface 127 and the base of the cigarette filling machine nipple (or side of the cigarette filling machine) (designated as "A" in FIG. 9) is about 4.4683 inches. In another embodiment, at the closed or load position (where the cigarette blank has been placed on the nipple), the distance between tube contact surface 127 and the base of the cigarette filling machine nipple (designated as "D" in FIG. 9) is about 3.3500 inches. In these embodiments, the distance along the X axis that is traveled as the tube loading arm moves from start position to the load position (designated as "C" in FIG. 9) is about 1.1183 inches.

Referring now to the embodiments depicted in FIGS. 1-3 and FIGS. 8A-B, filler chamber 105 of filler dispenser member 103 comprises a first side 139, a second side 140, a third side 141, and a fourth side 142. In this embodiment, engaged to first side 139 and second side 140, is a packing foot 143. In the embodiment shown in FIGS. 8A-B packing foot 143 is slidably engaged to said first side 139 and second side 140 such that a user of the device may raise or lower ("slide") the packing foot 143 vertically upwards and downwards by hand. In another embodiment, packing foot 143 may be spring activated whereby the foot 143 rebounds to a raised position (e.g. primary position) upon user release. In yet another embodiment, packing foot 143 may be engaged to other suitable retention element[s] other than a spring, such as a rubber band or the like, whereby said foot 143 is caused to return to its primary position upon release of downward pressure by the user. In the embodiments most clearly shown in FIGS. 8A-B, packing foot 143 may comprise a first hook, knob or extension 144 and a second hook, knob or extension 145 on its opposite side for engaging the first end of a rubber band or other retention element. Likewise filler chamber 105 comprises a first hook, knob or extension 146 and a second hook, knob or extension 147 for engaging the second end of a rubber band. Compression of the packing foot 143 causes the rubber band to stretch increasing the tension and thereby causing the packing foot 143 to return to the upward position upon release.

The packing foot 143 is designed to compress the filler or substrate within the substrate receptacle 148 built into the off the shelf cigarette rolling machine. In the embodiment depicted in FIGS. 8A-B, as the packing foot 143 is pressed downward by the user, the bottom end of the foot 143 contacts the substrate or filler that has been dropped into the substrate receptacle from the filler hopper via roller 149. In the embodiment shown in FIG. 8A, the primary position of the packing foot 143 may be defined as a fully open position whereby the packing foot is at its utmost vertical position and wherein the substrate receptor on the cigarette filling machine is unobstructed and can receive filling substrate from the filler hopper.

With continued reference to the embodiments depicted in FIGS. 1-3, filler chamber 105 may comprise a filler roller 149. As shown in FIGS. 1-2, filler roller 149 may be rotabably engaged to and supported by two sides of filler chamber 105, for example, second side 140 and third side 141. On the outside surface of second side 140 and third side 141 and connected to opposite ends of filler roller 149 is a first handle 150 and a second handle 151 (not shown). First handle 150 and second handle 151 provide user a means by which to rotate the filler roller 149 and advance the filler or substrate held by filler chamber 105 underneath a raised packing foot 143 and into a substrate receptacle built into the cigarette filling machine. Alternatively, filler roller 149 may comprise a single handle for turning the filler roller 149 or may comprise no handle. Filler roller 149 may, in said embodiment, be turned or rotated by a motor, by remote control, or the like.

Filler chamber 105 may further comprise a ramp 152 that is sloped toward packing foot 143 advancing filler toward filler roller 149 and foot 143. As filler advances toward foot 143 and filler roller 149 and as the user turns filler roller 149 the substrate substantially covers a slot or gap 153 formed between fourth side and the bottom surface of the filler chamber and descends downward to the substrate receptacle. Alternatively, filler chamber 105 does not have a sloped or inclined ramp, but rather has vertical sides as shown in FIGS. 1-3. Slot 153 is positioned in a manner that is substantially above and in a shared vertical plane with a substrate receptacle—a common feature in most if not all conventional cigarette filling machines. As the user rotates filler roller 149, a sufficient quantity of substrate advances through slot 153 and downward into the substrate receptacle. The user then advances the packing foot 143 downward and compresses the substrate within the substrate receptacle providing the proper amount of substrate for loading into the blank tube. The user also advances the tube loading arm 125 and the blank tube at rest on platform 124 toward nipple 154 which, like the substrate receptacle, is a common feature of most if not all conventional cigarette filling machines. It will be recognized by those of skill in the art that the nipple 154 defines an opening in the substrate receptacle whereby a spoon feeds the filler contained within substrate receptacle into a blank tube. It will further be recognized by those of skill in the art that the outer perimeter of nipple 154 is typically angled and that the open end of a tube must be placed over the nipple at a specific predetermined angle to avoid tear or mangling of the blank tube. Thus, it should be appreciated that the tube loading arm 125 is precisely positioned whereby movement of the arm 125 guides a tube toward the nipple 154 at the appropriate predetermined angle placing the open end of the tube over nipple 154 without tear or mangling.

In alternative embodiments, the apparatus may comprise additional features, for example, a button or switch press for starting or activating an automatic powered cigarette filling machine. For example, in one embodiment, an arm or shaft may extend from and be engaged to the filler chamber wherein said arm further comprises an end tab or hammer. Said hammer may be positioned proximal the cigarette filling machine power switch or button wherein said hammer may be manipulated by the user to interact with the power switch to start the machine.

In one embodiment, a user attaches the apparatus (in some embodiments, the filler dispenser) to an off the shelf cigarette filling machine resting the combination of components on a support surface of the user's choice. In some embodiments, the user then loads the filler chamber 105 with a substrate or filler and blank tubes upon the ramp 116 of tube hopper 115. Filler is advanced into the filler receptacle of the cigarette filling machine by roller 149 and compressed or packed into the filler receptacle with packing foot 143. The user then delivers the blank tube to the nipple via tube loading arm 125 and then releases the blank tube which is at this point substantially suspended on the nipple without further support awaiting filler delivery. When the filler is delivered to the blank tube via spoon extending through filler receptacle and out nipple, the filled tube is pushed off the nipple and onto a support surface such as a countertop, a table, a tray, the floor or the like. The tube loading arm 125 has resumed its primary position and receives another blank tube. In some embodiments, the tube loading arm 125 is designed such that as it advances the blank tube to the nipple, the tube loading arm blocks the next blank tube positioned at slot 123 from falling through causing blockage.

While the present invention has been described herein with respect to the exemplary embodiments, it will become apparent to one of ordinary skill in the art that many modifications, improvements and sub-combinations of the various embodiments, adaptations and variations can be made to the invention without departing from the spirit and scope thereof.

What is claimed is:

1. An adapter for a cigarette filling machine comprising:

a tube dispenser member further comprising a tube hopper, a tube loading arm, and a platform underneath and supporting said tube loading arm that is pivotably engaged to and rests upon said platform; and a filler chamber further comprising a filler hopper, a filler roller, and a packing foot;

wherein said tube dispenser member temporarily stores blank cigarette tubes on the ramp, dispenses blank cigarette tubes for filling in a controlled manner using the tube loading arm, and presents said blank cigarette tubes to said cigarette filling machine for filling with desired substrate; and wherein said filler chamber temporarily stores the desired substrate in said filler chamber, advances the substrate to the cigarette filling machine in a controlled manner with said roller, and packs the substrate into the cigarette filling machine for loading into the blank tube with said packing foot.

2. The adapter of claim 1 wherein said packing foot comprises a first member and a second member for securing one end of a retention element and wherein said filler hopper comprises a first member and a second member for securing a second end of a retention element.

3. The adapter of claim 1 wherein said filler chamber comprises a rear extension, a first front leg, and a second front leg for securing to a front side and a rear side of a cigarette filling machine.

4. The adapter of claim 1 wherein said filler chamber comprises a base wherein said base secures to a top surface of said cigarette filling machine.

5. The adapter of claim 1 wherein said tube hopper further comprises an inclined ramp for passive gravitational advancement of blank tubes within said hopper and a slot within said ramp for translocation of blank tubes one at a time to said tube loading arm.

6. The adapter of claim 1 wherein said tube loading arm further comprises an extension defined in the underside of said tube loading arm.

7. The adapter of claim 1 wherein said platform further comprises an angled slot for guiding said tube loading arm and a blank cigarette tube to the cigarette rolling machine for filling.

8. The cigarette filling machine of claim 1 wherein said tube loading arm further comprises a tube press, a tube contact surface, and a tab.

* * * * *